United States Patent [19]

Jacobson

[11] Patent Number: 4,586,255

[45] Date of Patent: May 6, 1986

[54] RAZOR BLADE ASSEMBLY

[75] Inventor: Chester F. Jacobson, Southboro, Mass.

[73] Assignee: The Gillette Company, Boston, Mass.

[21] Appl. No.: 660,954

[22] Filed: Oct. 15, 1984

[51] Int. Cl.[4] ..... B26B 21/44

[52] U.S. Cl. ..... 30/41; 30/50; 30/90

[58] Field of Search ..... 30/41, 47, 90, 50

[56] References Cited

U.S. PATENT DOCUMENTS

| | | | |
|---|---|---|---|
| 2,292,418 | 8/1942 | Wetherbee | 30/32 |
| 2,807,876 | 10/1957 | Barone | 30/90 |
| 3,517,442 | 6/1970 | Regan | 30/41 |
| 3,768,161 | 10/1973 | Miller | 30/41 |
| 3,969,817 | 7/1976 | DiBuono | 30/41 |
| 4,170,821 | 10/1979 | Booth | 30/41 |
| 4,270,268 | 6/1981 | Jacobson | 30/47 |
| 4,291,463 | 9/1981 | Williams | 30/346.53 |
| 4,381,293 | 4/1983 | Michel | 424/14 |
| 4,498,235 | 2/1985 | Jacobson | 30/47 |

FOREIGN PATENT DOCUMENTS 2024082A 5/1982 United Kingdom .

*Primary Examiner*—Donald R. Schran
*Assistant Examiner*—James L. Wolfe
*Attorney, Agent, or Firm*—Scott R. Foster

[57] ABSTRACT

A razor blade assembly comprising a molded plastic body member, a guard member mounted on the body member, blades are mounted on the body member, the body member including a back portion, the back portion having an opening therein, and an insert member fixed in the back portion opening, the insert member forming generally a continuation of top and rear surfaces of the back portion.

2 Claims, 3 Drawing Figures

RAZOR BLADE ASSEMBLY

BACKGROUND OF THE INVENTION

1. Field of the Invention

The invention relates to wet shaving implements and is directed more particularly to a blade assembly.

2. Description of the Prior Art

It is known in the art to provide a razor blade assembly which may be connected to, and used in conjunction with, a razor handle to facilitate shaving operations. U.S. Pat. No. 3,724,070, issued Apr. 3, 1973, in the name of Francis W. Dorion, Jr. shows a blade assembly in which blade means are held between blade assembly surfaces adapted to engage the surface being shaved in front of and behind, respectively, cutting edge portions of the blade means. Such surfaces are generally referred to as "guard" and "cap".

In U.S. patent application Ser. No. 419,202, filed Sept. 17, 1982, in the name of Chester F. Jacobson, and U.S. patent application Ser. No. 519,565, filed Aug. 2, 1983, in the name of Chester F. Jacobson, there are disclosed safety razor blade assemblies adapted for pivotal movement, as a whole, on razor handles during shaving operations, and further having blade means individually movable within the blade assemblies in response to forces encountered during shaving operations.

In U.S. Pat. No. 2,292,418 issued Aug. 11, 1942 to H. E. Wetherbee, it is suggested that providing a razor with a facility for leaching out therefrom of a shaving aid, by exposure of the aid to water during a shaving operation, will produce beneficial results. The suggestion is repeated, relative to a shaving cartridge or blade assembly, in U.S. Pat. No. 4,170,821 issued Oct. 16, 1979 to Anthony R. Booth and U.K. Pat. No. 2,024,082 published Jan. 9, 1980 in the name of Henry Pentney, et al.

SUMMARY OF THE INVENTION

An object of the present invention is to provide an improved safety razor blade assembly of the type disclosed in the above referred to application Ser. Nos. 419,202 and 519,565, including structure facilitating incorporation of a leaching feature.

With the above and other objects in view, as will hereinafter appear, a feature of the present invention is the provision of a safety razor blade assembly comprising a molded plastic body member, a guard member mounted on the body member, blade means mounted on the body member, the body member including a back portion, the back portion having an opening therein, and an insert member fixed in the back portion opening, the insert member forming generally a continuation of top and rear surfaces of the back portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
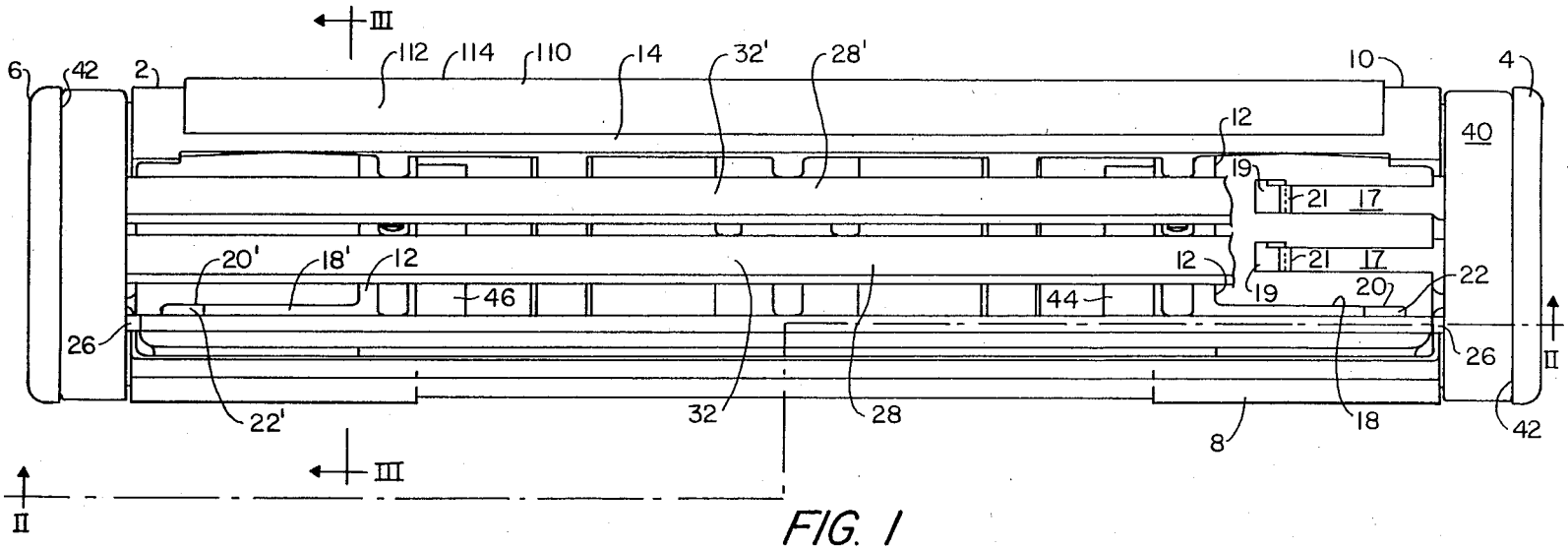
FIG. 1 is a top plan view, with portions broken away, of one form of blade assembly illustrative of an embodiment of the invention.
Figure 2:
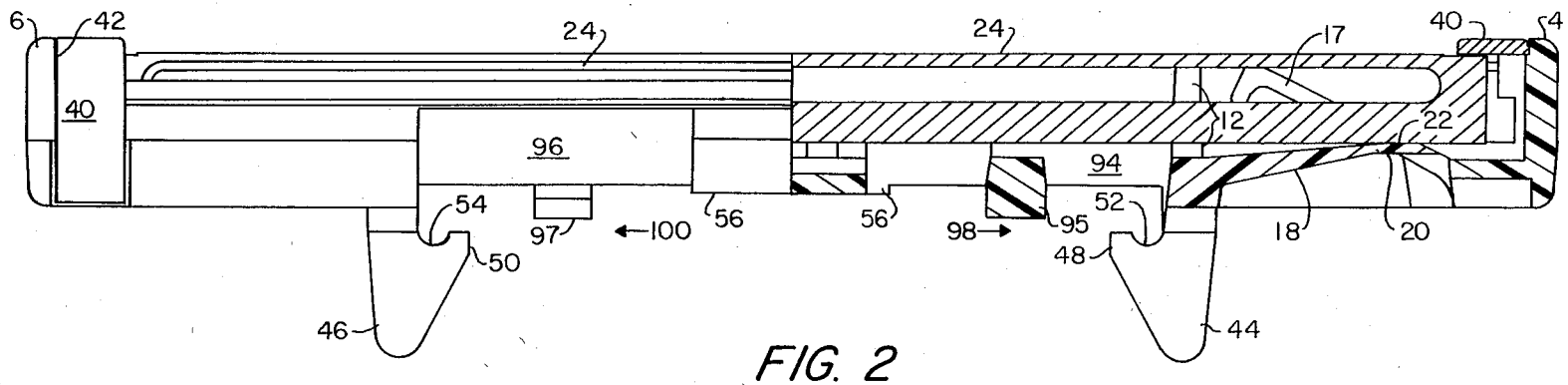
FIG. 2 is a front elevational and partly sectional view taken along line II—II of FIG. 1.

Referring to the drawings, it will be seen that the illustrative razor blade assembly includes a body member 2 having first and second end portions 4, 6 interconnected by front and back portions 8, 10. Frame portions 12 extend width-wise of the body member, interconnecting the front and back portions 8, 10.

Figure 3:
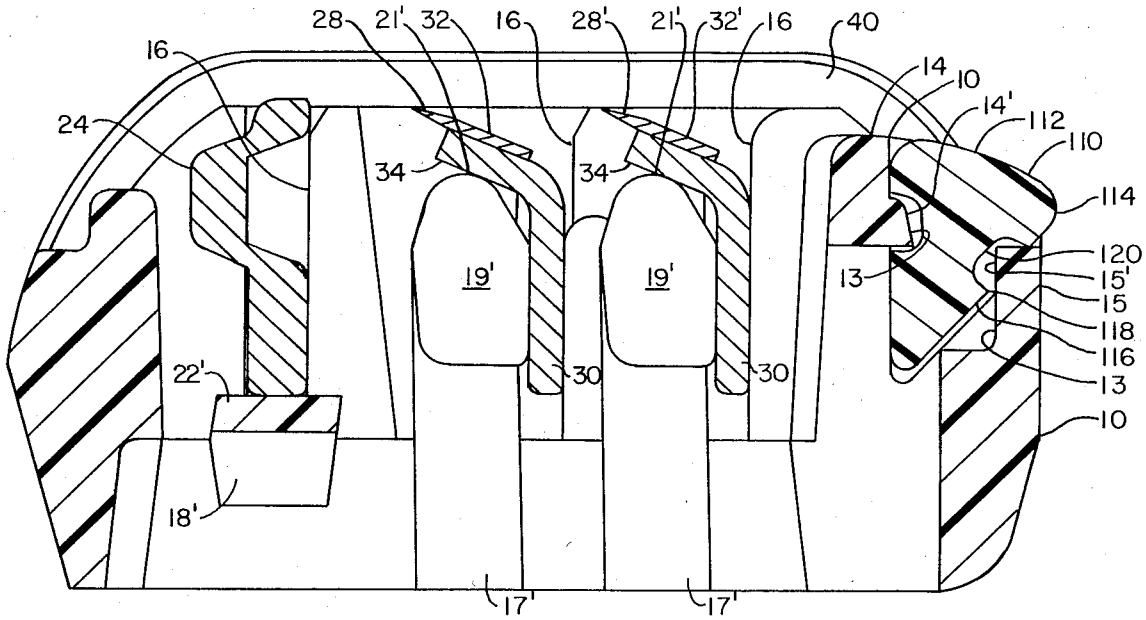
FIG. 3 is a sectional view taken along line III—III of FIG. 1.

The back portion 10 of the body member 2 has an upper surface portion 14 which engages skin being shaved behind the cutting means of the assembly, and a rear surface portion 15 (FIG. 3). The back portion 10 is provided with an elongated opening 13 defined in part by the upper surface portion 14 and the rear surface portion 15 of the back portion 10.

Each of the end portions 4, 6 is provided with opposed slots 16 disposed transversely to the frame portions 12. One of the frame portions 12 near the first end portion 4 is provided with a spring finger 18 extending therefrom generally parallel to the front and back portions 8, 10. The finger 18 is provided with an upturned end portion 20 having an upper surface 22. In like manner, another of the frame portions 12 near the second end portion 6 is provided with a spring finger 18' of similar configuration, with upturned end portions 20' having upper surfaces 22'. The fingers 18, 18' extend in opposite directions, the finger 18 extending toward the first end portion 4 of the body member 2 and the finger 18' extending toward the second end portion 6 of the body member. The fingers 18 and 18' are aligned with each other and with a pair of the slots 16. The first end portion 4 is provided with spring fingers 17 extending therefrom inwardly and upwardly of the body member. Each of the fingers 17 is provided with an upturned end portion 19 having an upper surface 21. In like manner, the second end portion 6 is provided with spring fingers 17' (FIG. 3) of similar configuration, with upturned end portions 19' having upper surfaces 21'. The fingers 17, 17' extend in generally opposite directions, the fingers 17 extending from the first end portion 4 generally toward the second end portion 6, and the fingers 17' extending from the second end portion 6 generally toward the first end portion 4. The fingers 17, 17' are each aligned with a pair of the slots 16.

The assembly includes a guard portion 24 having a slide member 26 at either end thereof. The slide members 26 are received in a pair of opposed slots 16 nearest the front portion 8. The bottom of the guard portion rests upon the surfaces 22, 22' of the spring fingers 18, 18'. The lower edges of the slide members 26 rest above the bottoms of their slots 16, allowing the guard portion 24 to be moved further into the slots, against the bias of the spring fingers 18, 18' therebeneath. The spring fingers supporting the guard portion comprise a set of spring fingers, the object of which is to resiliently support the guard portion. In a shaving operation, the guard portion travels over the surface being shaved ahead of the cutting means.

The assembly further includes blade means 28 comprising a blade base portion 30, a cutting edge portion 32 extending from the base portion, and slide portions at either end of the base portion. The slide portions which may be merely extensions of the blade base portions 30, are received in a pair of the opposed slots 16. An underside 34 of the blade cutting edge portion 32 is engaged by the surfaces 21, 21' of a pair of the spring fingers 17, 17'. Lower edges of the slide portions are spaced from the bottoms of their slots to permit movement of the blades further into the slots 16 against the bias of the spring fingers 17, 17' on which the blade cutter portion rests. The spring fingers supporting the blade cutter portion 32 comprise another set of spring fingers, the object of which is to resiliently support the blade means thereon.

In the embodiment illustrated, the blade means include a second blade 28' having a base portion 30', a cutting edge portion 32', and slide portions all anchored similarly to the above-described first blade means. The slide portions of the second blade are received in a third pair of the opposed slots 16 nearest the back portion 10 with the cutter portion 32' resting upon spring finger surfaces 21, 21'. The spring fingers supporting the second blade comprise still another set of spring fingers, which resiliently support the second blade. In a shaving operation, the second blade travels over the surface being shaved behind the first blade.

The guard portion 24, first and second blades 28, 28' are clamped in place by spring clamps 40, which are received in slots 42 in the end portions 4, 6. The clamps 40 engage the guide portion 24 and blades 28, 28' forcing them into the slots 16 to a point where a slight stress is placed on the spring fingers.

On the underside of the body member 2 and the frame portions 12, are disposed two extensions 44, 46 having at their free ends, respectively, inwardly extending opposed rails 48, 50, each rail having respective arcuate upper surfaces 52, 54. The extensions comprise a pivot mounting means by which the blade assembly may be removably and pivotally attached to a razor handle. The blade assembly body member underside is additionally provided with cam means 56 adapted to receive a cam follower operative to urge the blade assembly to a given position.

The blade assembly rails 48, 50, in conjunction with undersurfaces 94, 96 of the body member 2, and arcuate struts 95, 97, define arcuate slots 98, 100 adapted to receive razor handle shell bearings (not shown). The shell bearings comprise a pivot mounting means adapted to cooperate with the above described blade assembly pivot mounting means to facilitate pivotal connection of the blade assembly to the razor handle assembly.

In the handle there is disposed a coil spring and a plunger member the spring biasing the plunger in the direction of the free end of the plunger member. When the blade assembly is connected to the handle assembly, the free end of the plunger member is urged by the spring into engagement with the blade assembly cam means 56. During pivoting operation of the blade assembly, the plunger end bears against the cam means 56, to urge the blade assembly to a given position.

Referring again to FIG. 3, it will be seen that the opening 13 constitutes a gap between the back portion upper surface portion 14 and the back portion rear surface portion 15. Disposed in the opening 13 is an insert member 110 having a top surface 112 rounding into a rear surface 114 to generally form a continuation of the back portion upper and rear surface portions. The insert member 110 preferably is elongated, extending over a majority of the length of the blade assembly (FIG. 1), and in cross-section (FIG. 3) includes a wedge-shaped portion 116 having a widest point 118 wider than the afore-mentioned gap. The wedge-shaped portion is adapted to be urged through the gap, in assembly, to become permanently lodged in the opening 13. The insert member 110 includes a waist portion 120 adjacent the widest point 118 and adapted to receive portion 14', 15' of the back portion upper surface portion 14 and the back portion rear surface portion 15 to lock the insert member 110 in the opening 13.

The insert member preferably is made of a material comprising a mixture of a hydrophobic material and a water leachable hydrophilic polymeric material.

During a shaving operation, the guard portion 24 and the blades 28, 28' move independently of each other against the bias of the spring fingers. Simultaneously, the blade assembly, as a whole, pivots on the handle, following the contours of the surface being shaved. When the insert member 110 comes in contact with water, the hydrophilic material leaches out of the insert member and is deposited on the surface being shaved.

It is to be understood that the present invention is by no means limited to the particular construction herein disclosed and/or shown in the drawings, but also comprises any modifications or equivalents within the scope of the disclosure. For example, it is preferable under certain conditions that the guard portion be immovable. An alternative embodiment includes a guard portion fixed immovably to the blade assembly body member, but in all other respects structured and operated in accordance with the above description. As a further example, the blade means may include a single blade, rather than the two blade arrangement described, the single blade being used in conjunction with either a movable or stationary guard portion.

What is claimed is:

1. A razor blade assembly comprising a body member of molded plastic including a front portion and a back portion, a guard member mounted on said body member, blade means mounted on said body member rearwardly of said guard, the back portion of said body member having an upper surface portion and a rear surface portion, said back portion having an opening therein, said opening being defined in part by a rear portion of said back portion and the upper surface of said back portion, said back portion rear surface and the upper surface portion of said back portion being angularly offset relative to one another and an insert member fixed in said opening, said insert member including a wedge-shaped portion and said opening being in part defined by a gap between said back portion upper surface and said back portion rear surface portion, said wedge-shaped portion at its widest point being wider than said gap, but adapted to be urged through said gap, in assembly, to become permanently lodged in said opening and in which said insert member is comprised of a mixture of hydrophobic material and a water leachable hydrophilic polymeric material.

2. A razor blade assembly comprising a body member of molded plastic, said body member including a front portion, a back portion, spring finger guard support means, and spring finger blade support means, a guard member mounted on said body member and biased by said spring finger guard support means, blade means mounted on said body member rearwardly of said guard and biased by said spring finger blade support means, said back portion of said body member having an opening therein, said opening being defined in said back portion by an upper surface portion and a back portion rear surface portion, and an insert member including a wedge-shaped portion and said opening being in part defined by a gap between said back portion upper surface and said back portion rear surface portion which are relatively angularly offset, said wedge-shaped portion at its widest point being wider than said gap, but adapted to be urged through said gap, in assembly, to become permanently lodged in said opening, said insert member having a top surface rounding into a rear surface to generally form a continuation of said back portion upper and rear surface portions, and said insert member being comprised of a mixture of hydrophobic material and a water leachable hydrophilic polymeric material.

* * * * *